United States Patent [19]

Burandt

[11] Patent Number: 4,915,016

[45] Date of Patent: Apr. 10, 1990

[54] HYDROMECHANICAL CONTROL SYSTEM FOR A POWER DRIVE UNIT

[75] Inventor: Wesley A. Burandt, Rockford, Ill.

[73] Assignee: Sundstrand Corporation, Rockford, Ill.

[21] Appl. No.: 179,025

[22] Filed: Apr. 7, 1988

[51] Int. Cl.[4] ..... F01B 13/04

[52] U.S. Cl. ..... 91/482

[58] Field of Search ..... 91/482, 483, 475, 505, 91/484, 485

[56] References Cited

U.S. PATENT DOCUMENTS

| | | | |
|---|---|---|---|
| 2,546,583 | 3/1951 | Born | 91/482 |
| 2,749,844 | 6/1956 | Weisenbach | 91/475 |
| 2,847,938 | 8/1958 | Gondek . | |
| 2,963,983 | 12/1960 | Wiggermann | 91/6.5 |
| 3,073,252 | 1/1963 | Kamps | 91/482 |
| 3,190,232 | 6/1965 | Budzich | 91/482 |
| 3,204,569 | 9/1965 | Firth | 91/482 |
| 3,237,569 | 3/1966 | Reaume . | |
| 3,616,727 | 11/1972 | Suzuki et al. | 91/499 |
| 3,823,557 | 7/1974 | Van Wagenen et al. | 60/325 |
| 3,866,518 | 2/1975 | Miyao et al. | 91/488 |
| 4,007,663 | 2/1977 | Nagatomo et al. | 91/6.5 |
| 4,487,109 | 12/1984 | Burandt et al. | 91/506 |
| 4,644,850 | 2/1987 | Kanamaru et al. | 91/507 |

*Primary Examiner*—Leonard E. Smith

*Attorney, Agent, or Firm*—Wood, Phillips, Mason, Recktenwald & Vansanten

[57] ABSTRACT

A hydromechanical control system for a power drive unit having a hydraulic motor of the axial piston type, including a wobbler to vary the axial displacement of the pistons of the motor. A cylinder block is coupled to a shaft for rotation therewith. The cylinder block defines a plurality reciprocally movable therein. A port plate is provided at one end of the cylinder block, with kidney-shaped ports concentric with the axis of rotation of the cylinder block, in alignment with the cylinders and in communication with fluid supply and return conduits. A solenoid-operated piston-cylinder device rotatably adjusts the position of the port plate to adjust the positions of the ports relative to the incline plane of the wobbler.

11 Claims, 1 Drawing Sheet

HYDROMECHANICAL CONTROL SYSTEM FOR A POWER DRIVE UNIT

FIELD OF THE INVENTION

This invention generally relates to hydraulic control systems and, particularly, to a hydromechanical system for a variable displacement power drive unit.

BACKGROUND OF THE INVENTION

In the aircraft industry there are a myriad of situations where hydraulic power is called upon in airplanes to effect the actuation of a component. Many aircraft have flight control surfaces, such as flaps or a horizontal stabilizer surface, that are moved and positioned by an aircraft actuation system incorporating a hydraulic motor of the axial piston type. The hydraulic motor has a variably positionable wobbler for controlling displacement of the motor. A control structure is provided for causing fluid flow through the motor. The motor includes a rotatable cylinder block with a series of cylinders, and respective pistons, arranged in a circular array for rotation with the cylinder block. The control structure further includes a piston connected to the wobbler for setting the motor at either minimum or maximum conditions or any condition therebetween. A servo valve also is provided for setting the position of the piston in the control system. The piston is responsive to the pressure drop across the motor in either direction of operation to set the motor displacement at the least value possible for the load condition on the motor.

An example of hydraulic motors having variably positionable wobblers for controlling displacement of the motor are shown in my U.S. Pat. No. 4,487,109, dated Dec. 11, 1984, which is assigned to the assignee of the present invention.

For primary flight control surfaces in aircraft, energy efficient power drive units of the character described above conserve hydraulic power. Hydraulic flow requirements generally are determined by the design point. This is true when the ratio of no-load rate to design point rate is approximately 4:1 or less. This invention addresses conservation of flow at low-load when the low-load rate to design point rate is greater than 4:1. In other words, hydromechanical actuation systems for primary flight control surfaces have two operating modes, namely: a high load/low rate (design point) and a low-load/high rate. At low-load operation, the wobbler will seek a minimum displacement to maintain continued operation. For an application where the ratio of no-load rate to design point rate is greater than 4, the motor wobbler displacement required may be so low (i.e. less than 1.5°) that the unit will not start or continue to run. The present invention addresses this problematic condition by employing an adjustable port plate combined with the variable displacement wobbler, as described in greater detail hereinafter.

SUMMARY OF THE INVENTION

An object, therefore, of the invention is to provide a new and improved hydromechanical control system for a power drive unit having a hydraulic motor of the axial piston type.

In the exemplary embodiment of the invention, generally, the hydraulic motor includes a wobbler to vary the axial displacement of the pistons of the motor. A cylinder block is coupled to a shaft for rotation therewith and defines a plurality of cylinders each having one of the pistons reciprocally movable therein. A port plate is provided at one end of the cylinder block, the port plate having port means in alignment with the cylinders and in communication with fluid supply and return means. Means are provided for adjusting the position of the port plate to adjust the position of the port means relative to the incline plane of the wobbler.

More particularly, the cylinders and their respective pistons are arranged in the cylinder block concentric about an axis of rotation of the block. The port plate has generally kidney-shaped supply and return ports concentric with the axis, i.e. in the path of rotation of the cylinders. The port plate is rotatable about the axis for varying the angular positions of the kidney-shaped ports. For instance, the ports may be in a conventional position on opposite sides of a line passing through the axis between the maximum and minimum displacement positions of the wobbler. In other words, the kidney-shaped ports are working on the inclined planes of the wobbler. If the port plate is rotated, the entire area of the kidney-shaped ports no longer are working on the inclined planes. Therefore, the combination of the wobbler and the rotatable port plate would be effective to "eliminate" a number of pistons that operate across the inclined plane of the wobbler during no-load operation. Once this has occurred for a given no-load rate condition, the wobbler will compensate. This compensation will permit the wobbler to operate at a high angle but still provide the hydraulic flow conservation feature of the invention. Therefore, it can be seen that there exists a relationship between the port plate (i.e. the kidney-shaped ports) and the wobbler plate.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
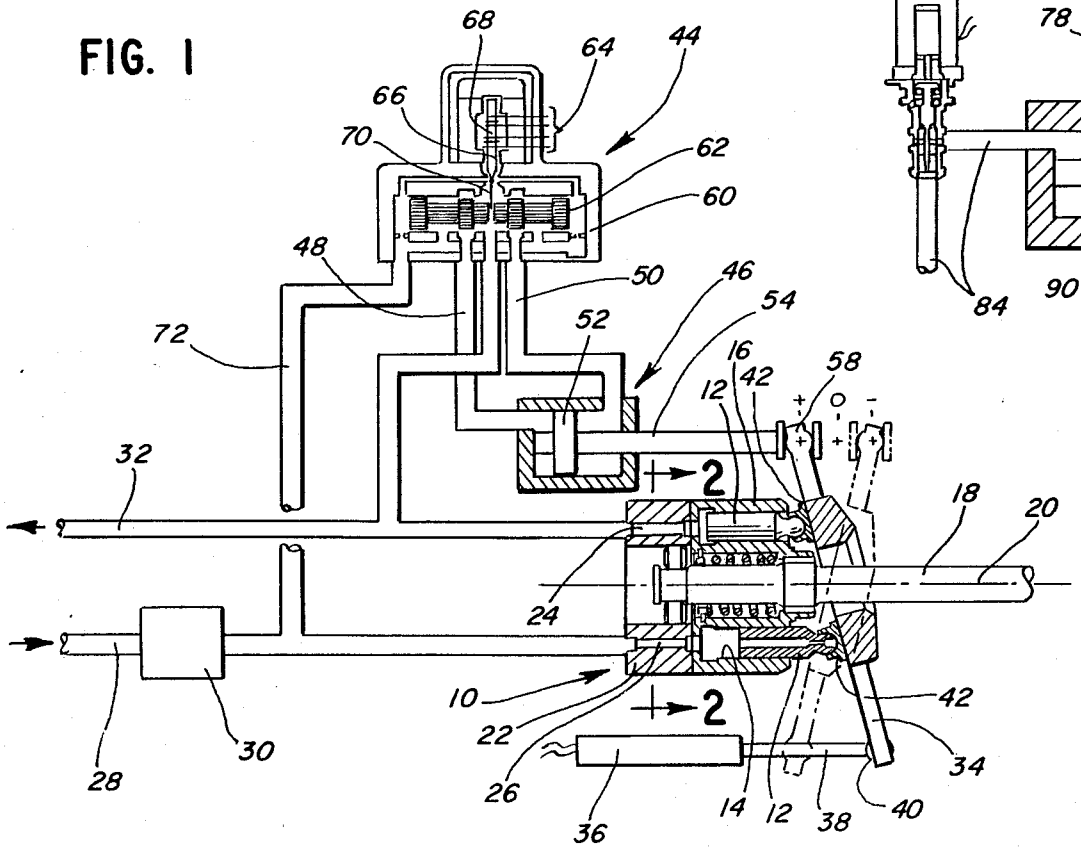
FIG. 1 is a schematic illustration of a hydromechanical control system for a power drive unit with certain components shown in central vertical section.

Referring to the drawings in greater detail, and first to FIG. 1, a variable displacement hydraulic motor, generally designated 10, is shown in the form of an axial displacement piston motor. As is well known in the art, an axial piston motor has a series of pistons 12 carried within a series of longitudinal bores or cylinders 14 in a cylinder block 16 which connects to an output shaft 18. Cylinder block 16, along with pistons 12, rotate with output shaft 18. With the motor of the invention, cylinders 14 and pistons 12 are arranged in a circular array about the cylinder block concentric with an axis of rotation 20 of the block and output shaft.

A port plate 22, forming part of the motor, has a pair of ports 24 and 26. Port 26 receives pressure from a supply line 28, through an inlet strainer 30, and the other port 24 is connected to a return line 32.

The power drive unit provides for infinitely variable positioning of a wobbler plate 34 to have the wobbler angle change to vary the stroke of the pistons and, therefore, motor displacement of cylinder block 16 to thereby cause the hydraulic motor output to match the bi-directional load experienced by output shaft 18. Reversal of the hydraulic motor 10 is accomplished by movement of wobbler plate 34 from, for example, the position shown to a vertical or zero angle position and then on to the right as shown by dotted lines in FIG. 1. A wobbler position transducer 36 is connected to wobbler plate 34 by a shaft 38 and a universal joint 40 for moving the wobbler plate and changing its angle, as described. The pistons each are in contact with wobbler plate 34 by a sliding connection or slipper 42. All of the above-described structure is fairly conventional as shown in my aforementioned U.S. patent.

Furthermore, as shown in U.S. Pat. No. 4,487,109, an electro-hydraulic servo valve, generally designated 44, is hydraulically coupled to a wobbler control piston unit, generally designated 46, by conduits 48 and 50. A piston 52 within piston unit 46 is secured to a piston rod 54 and movable within a piston sleeve or cylinder 56. A ball joint 58 is disposed at the right-hand end of piston rod 54 and mechanically couples the rod to the upper end of wobbler plate 34.

Servo valve 44 includes a valve body 60 and a controlled movable valve element 62. This servo valve is conventional in construction and responds to signals delivered to coil wires 64 to cause an armature 66 to pivot about a pivot point 68. Pivotal movement of the armature results in blocking a nozzle 70 causing an unbalanced hydraulic force upon valve element 62 to move the valve element either to the right or left as viewed in FIG. 1. Movement of the valve element causes fluid under pressure to be delivered to either side of piston 52 in a conventional manner from supply port 28 via branch 72 and either conduit 48 or 50.

The invention contemplates means for adjusting port plate 22 for adjusting the position of ports 24,26. More particularly, referring to FIG. 2, port plate 22 is generally disc-shaped and is mounted for rotation about axis 18. Ports 24 and 26 are generally kidney-shaped concentric with axis 18 and in the path of movement of cylinders 14 and pistons 12. The port plate is connected by a bell crank 74 to a piston rod 76 of a piston 78 reciprocally mounted within a cylinder 80 of a port plate piston-and-cylinder control means, generally designated 82. Some lost motion means can be provided between bell crank 74 and piston rod 76 for transmitting linear to rotational movement. A supply conduit 84 is in communication with cylinder 80 through a solenoid valve, generally designated 86. A return conduit 88 extends out the opposite end of cylinder 80. A stabilizing spring 90 is disposed within the cylinder on the return side of piston 78. Therefore, it can be seen that actuation of the solenoid valve is effective to cause reciprocal movement of piston 80 and, in turn, rotational adjusting movement of port plate 22 in the direction of the arrow 90.

Figure 2:
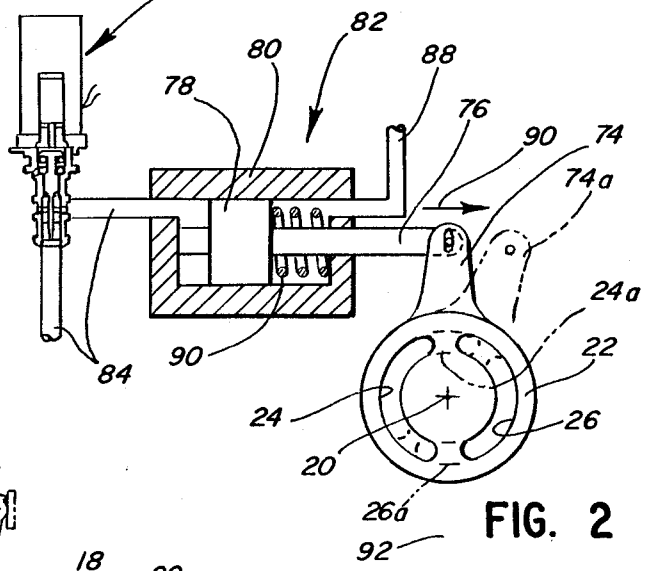
FIG. 2 is a section taken generally in the direction of arrow 2—2 of FIG. 1, showing the port plate and means for rotating the port plate.

Port plate 22 is shown in FIG. 2 in full lines with ports 24 and 26 angularly located for full displacement of pistons 12. It can be seen that the ports are generally kidney-shaped and, in full displacement position, are symmetrical on opposite sides of an imaginary line 92 passing through axis 18, the imaginary line being angularly oriented (i.e. top-to-bottom) between the extreme angular positions of wobbler plate as viewed in FIG. 1. In other words, the inclination of the wobbler plate defines a top dead center position and a bottom dead center position of the pistons to effect a compression stroke and a suction stroke. Normally, the ports are symmetrical on opposite sides of a line through these positions.

Port plate 22 is shown with crank arm 74 in dotted lines, as indicated at 74*a*, and with ports 24 and 26 shown in dotted lines at 24*a* and 26*a*. This represents a reduced displacement condition for the pistons 12.

In operation, as stated in context in the Summary portion above, during a low-load operation, the rotated position of the port plate effectively "eliminates" a number of pistons that operate across the incline plane of wobbler plate 34. Once this has occurred for a given no-load rate condition, the wobbler would compensate. This compensation would permit the wobbler plate to operate at a high angle but still provide a hydraulic flow conservation feature.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of controlling a hydromechanical power drive unit having a hydraulic motor of the axial piston type, including a cylinder block defining a plurality of cylinders each having one of said pistons reciprocally movable therein, a wobbler to vary the axial displacement of the pistons of the motor, and a port plate at one end of the cylinder block having port means in alignment with the cylinders and in communication with fluid supply and return means, comprising the steps of:

varying the angular position of the wobbler; and adjusting the position of the port plate to adjust the position of the port means relative to an incline plane of the wobbler independently of the functioning of the hydraulic motor and the varying of the angular position of the wobbler.

2. A hydromechanical control system for a power drive unit having a hydraulic motor of the axial piston type, comprising:

a cylinder block coupled to a shaft for rotation therewith about an axis and defining a plurality of cylinders each having one of said pistons reciprocally movable therein;

a wobbler to vary the axial displacement of the pistons of the motor;

means for varying the angular position of the wobbler;

a port plate mounted at one end of the cylinder block for adjusting rotation about said axis, the port plate having kidney-shaped supply and return ports concentric with said axis; and piston and cylinder means independent of the hydraulic motor and the means for varying the angular position of the wobbler for rotating the port plate about said axis for adjusting the angular positions of the kidney-shaped ports relative to an incline plane of the wobbler.

3. The hydromechanical control system of claim 2 wherein said kidney-shaped ports, in normal condition, are located generally on opposite sides of a line passing through opposite dead center positions defined by the incline plane of the wobbler.

4. The hydromechanical control system of claim 2 wherein said piston and cylinder device is coupled to the port plate for rotating the port plate in response to movement of the piston.

5. A hydromechanical control system for a power drive unit having a hydraulic motor of the axial piston type, comprising:

a cylinder block coupled to a shaft for rotation therewith about an axis and defining a plurality of cylinders each having one of said pistons reciprocally movable therein;

a wobbler to vary the axial displacement of the pistons of the motor;

means for varying the angular position of the wobbler;

a port plate at one end of the cylinder block having port means in alignment with the cylinders and in communication with fluid supply and return means; and means independent of the hydraulic motor and the means for varying the angular position of the wobbler for adjusting the position of the port plate to adjust the position of the port means relative to an incline plane of the wobbler.

6. The hydromechanical control system of claim 1 wherein said adjusting means include means for rotating the port plate about said axis.

7. The hydromechanical control system of claim 6 wherein said port means include generally kidney-shaped supply and return ports concentric with said axis for varying the angular positions of the ports.

8. The hydromechanical control system of claim 7 wherein said kidney-shaped ports, in normal condition, are located generally on opposite sides of a line passing through opposite dead center positions defined by the incline plane of the wobbler.

9. The hydromechanical control system of claim 5 wherein said adjusting means include a piston and cylinder device.

10. The hydromechanical control system of claim 9 wherein said port plate is mounted for adjusting rotation about said axis.

11. The hydromechanical control system of claim 10 wherein said piston and cylinder device is coupled to the port plate for rotating the port plate in response to movement of the piston.

* * * * *